US009425559B2

(12) United States Patent
Kao et al.

(10) Patent No.: US 9,425,559 B2
(45) Date of Patent: Aug. 23, 2016

(54) ELECTRICAL RECEPTACLE CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW)

(73) Assignee: ANVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/799,105

(22) Filed: Jul. 14, 2015

(65) Prior Publication Data

US 2016/0013593 A1 Jan. 14, 2016

(30) Foreign Application Priority Data

Jul. 14, 2014 (TW) ..... 103124184 A
Nov. 28, 2014 (TW) ..... 103141533 A

(51) Int. Cl.

| | |
|---|---|
| ***H01R 13/648*** | (2006.01) |
| ***H01R 13/6585*** | (2011.01) |
| *H01R 24/60* | (2011.01) |
| *H01R 107/00* | (2006.01) |
| *H01R 13/6471* | (2011.01) |

(52) U.S. Cl.

CPC ..... *H01R 13/6585* (2013.01); *H01R 13/6471* (2013.01); *H01R 24/60* (2013.01); *H01R 2107/00* (2013.01)

(58) Field of Classification Search

CPC ..... H01R 13/6587; H01R 13/6594; H01R 23/6873; H01R 23/7073
USPC ..... 439/607.4, 607.35, 607.36
See application file for complete search history.

(56) References Cited

U.S. PATENT DOCUMENTS 6,074,225 A * 6/2000 Wu ..... H01R 23/6873 439/101
9,231,356 B1 * 1/2016 Ju ..... H01R 24/78
9,281,626 B2 * 3/2016 Lin ..... H01R 13/6581
9,300,095 B2 * 3/2016 Lin ..... H01R 24/60

FOREIGN PATENT DOCUMENTS

CN 1960069 A 5/2007
CN 201374433 Y 12/2009

* cited by examiner

*Primary Examiner* — Phuong Dinh
(74) *Attorney, Agent, or Firm* — Muncy, Geissler, Olds & Lowe, P.C.

(57) ABSTRACT

An electrical receptacle connector includes an insulated housing, a metallic shell and a plurality of connecting portions. The insulated housing is in the metallic shell. The metallic shell includes a tubular body, a connecting plate and a folded portion. The tubular body includes an outer wall and an inner wall. The connecting plate is at the outer wall or the inner wall, and the folded portion is extended from the tubular body toward the connecting plate. The connecting portions are configured to fix the connecting plate to the tubular body so that the connecting plate is fixed on the tubular body.

19 Claims, 12 Drawing Sheets

| | | | | | | | | | | | | |
|---|---|---|---|---|---|---|---|---|---|---|---|---|
| GND | TX1+ | TX1− | VBUS | CC1 | D+ | D− | RFU | VBUS | RX2− | RX2+ | GND | 2 |
| GND | RX1+ | RX1− | VBUS | RFU | D− | D+ | CC2 | VBUS | TX2− | TX2+ | GND | 3 |

FIG. 6A

ELECTRICAL RECEPTACLE CONNECTOR

CROSS-REFERENCES TO RELATED APPLICATIONS

This non-provisional application claims priority under 35 U.S.C. §119(a) on Patent Application No. 103124184 and 103141533, filed in Taiwan, R.O.C. on 2014 Jul. 14 and 2014 Nov. 28, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

An existing USB electrical receptacle connector includes an insulated housing and a metallic shell, wherein the insulated housing is received in the metallic shell. The metallic shell includes a plurality of grounding sheets and a plurality of breaches. One end of each of the grounding sheets is extended from an inner wall of the corresponding breach, so that effective noise grounding and conduction can be accomplished via the grounding sheets which are respectively inserted into the through holes of the circuit board.

Nevertheless, during operation, the existing USB electrical receptacle connector provides poor shielding performance due to exposure of the breaches of the metallic shell, causing interference problems such as electromagnetic interference (EMI), radio frequency interference (RFI), etc. As a result, severe crosstalk problems are common when the existing USB electrical receptacle connector is used for signal transmission.

SUMMARY OF THE INVENTION

It is therefore necessary to establish and develop a new architecture of USB connectors to address the previously mentioned needs of platforms and devices, while retaining all of the functional benefits of USB that form the basis for this most popular of computing device interconnects.

In view of this, the instant disclosure provides an electrical receptacle connector. An embodiment of the electrical receptacle connector comprises an insulated housing, a plurality of upper-row receptacle terminals, a plurality of lower-row receptacle terminals, a metallic shell, and a plurality of connecting portions. The insulated housing comprises a base portion and a tongue portion extended from one side of the base portion in the front-to-rear direction, and the tongue portion has an upper surface and a lower surface. The upper-row receptacle terminals comprise a plurality of signal terminals, at least one power terminal, and at least one ground terminal. Each of the upper-row receptacle terminals is held in the base portion and disposed at the upper surface of the tongue portion. The lower-row receptacle terminals comprise a plurality of signal terminals, at least one power terminal, and at least one ground terminal. Each of the lower-row receptacle terminals is held in the base portion and disposed at the lower surface of the tongue portion. The insulated housing is received in a receiving cavity defined in the metallic shell. The metallic shell comprises a tubular body, at least one connecting plate, and at least one folded portion. The tubular body has an outer wall and an inner wall. The connecting plate is at the outer wall or the inner wall. The folded portion is extended from the tubular body toward the at least connecting plate. The connecting portions are configured to connect the connecting plate to the tubular body so that the connecting plate is fixed on the tubular body.

In conclusion, the connecting plates are configured to two sides of the tubular body by the connecting portions, so that the connecting plates are fixed with the tubular body, and the distance between the connecting plates are fixed to allow the through-hole legs of the connecting plates to be inserted into the through holes of the circuit board. Furthermore, since the folded portions and the connecting plates are configured to the two sides of the tubular body, the existing insufficient shielding issue caused by the breaches of the existing connector can be improved. Additionally, improved noise grounding and conduction can be accomplished, thereby performing a better EMI shielding so as to reduce the EMI and RFI problems. Furthermore, pin-assignments of the upper-row receptacle terminals and the lower-row receptacle terminals are 180 degree symmetrical, dual or double orientation design which enable an electrical plug connector to be inserted into the electrical receptacle connector in either of two intuitive orientations, i.e., in either upside-up or upside-down directions. In other words, the pin-assignments of the upper-row receptacle terminals and the lower-row receptacle terminals have 180 degree symmetrical, dual or double orientation design with respect to a central point of the receptacle cavity as the symmetrical center. Consequently, an electrical plug connector is inserted into the electrical receptacle connector with a first orientation where the upper surface of the tongue portion is facing up, for transmitting first signals. Conversely, the electrical plug connector is inserted into the electrical receptacle connector with a second orientation where the upper surface of the tongue portion is facing down, for transmitting second signals. Furthermore, the specification for transmitting the first signals is conformed to the specification for transmitting the second signals.

Detailed description of the characteristics, and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 6A is a schematic configuration diagram of the receptacle terminals of the electrical receptacle connector of the first embodiment;

DETAILED DESCRIPTION

Figure 1:
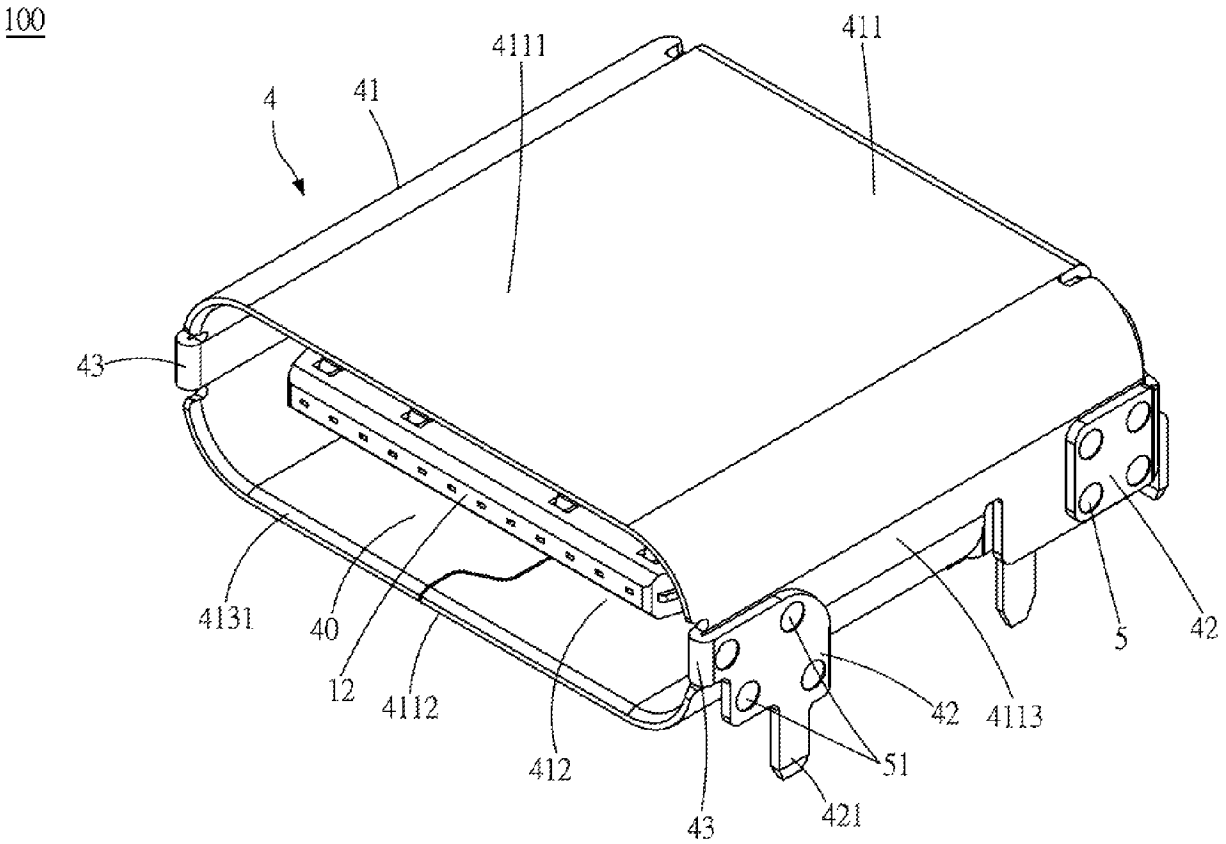
FIG. 1 is a perspective view of an electrical receptacle connector according to a first embodiment of the instant disclosure.
Figure 2:
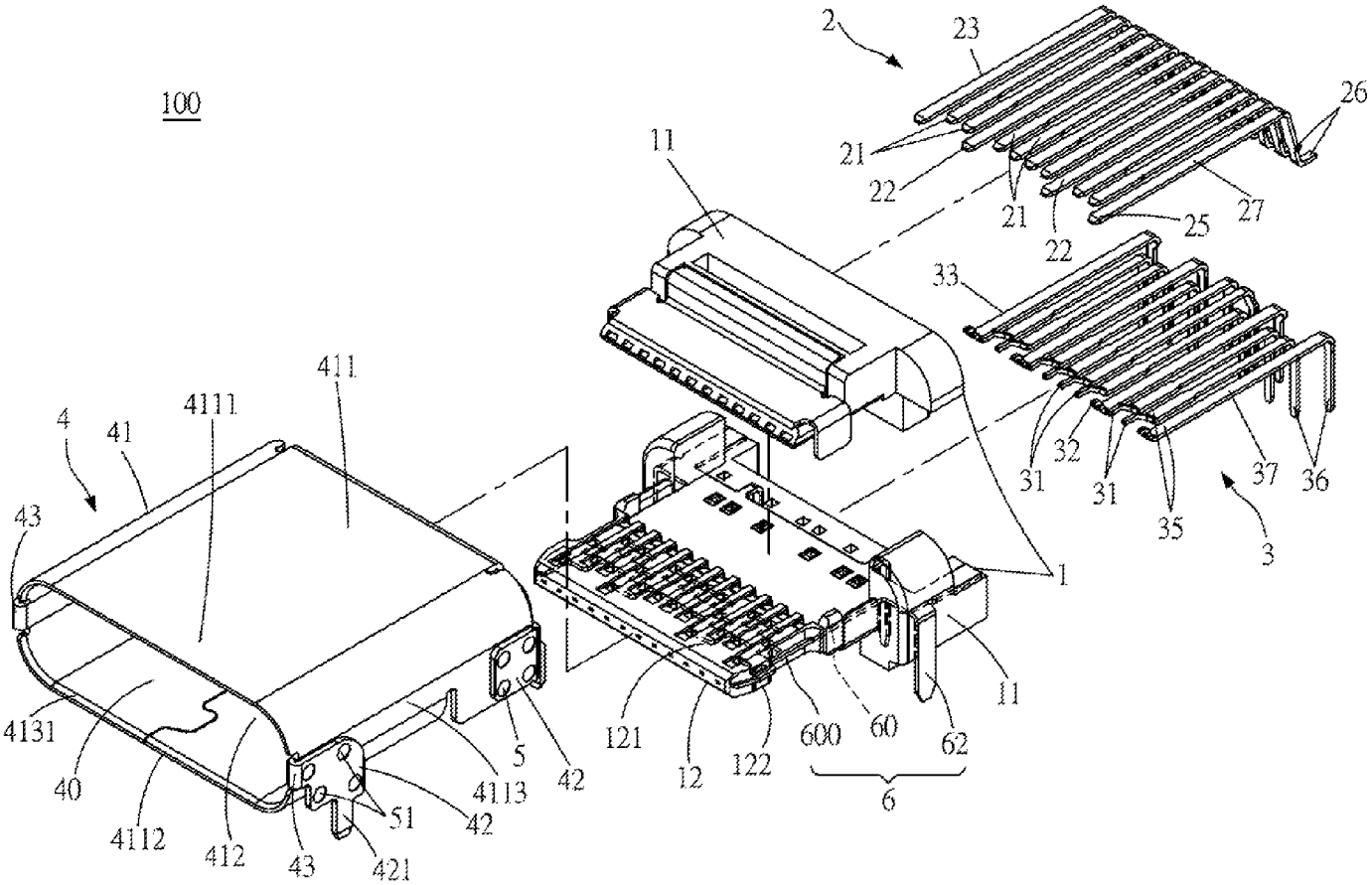
FIG. 2 is an exploded view of the electrical receptacle connector of the first embodiment.
Figure 3:
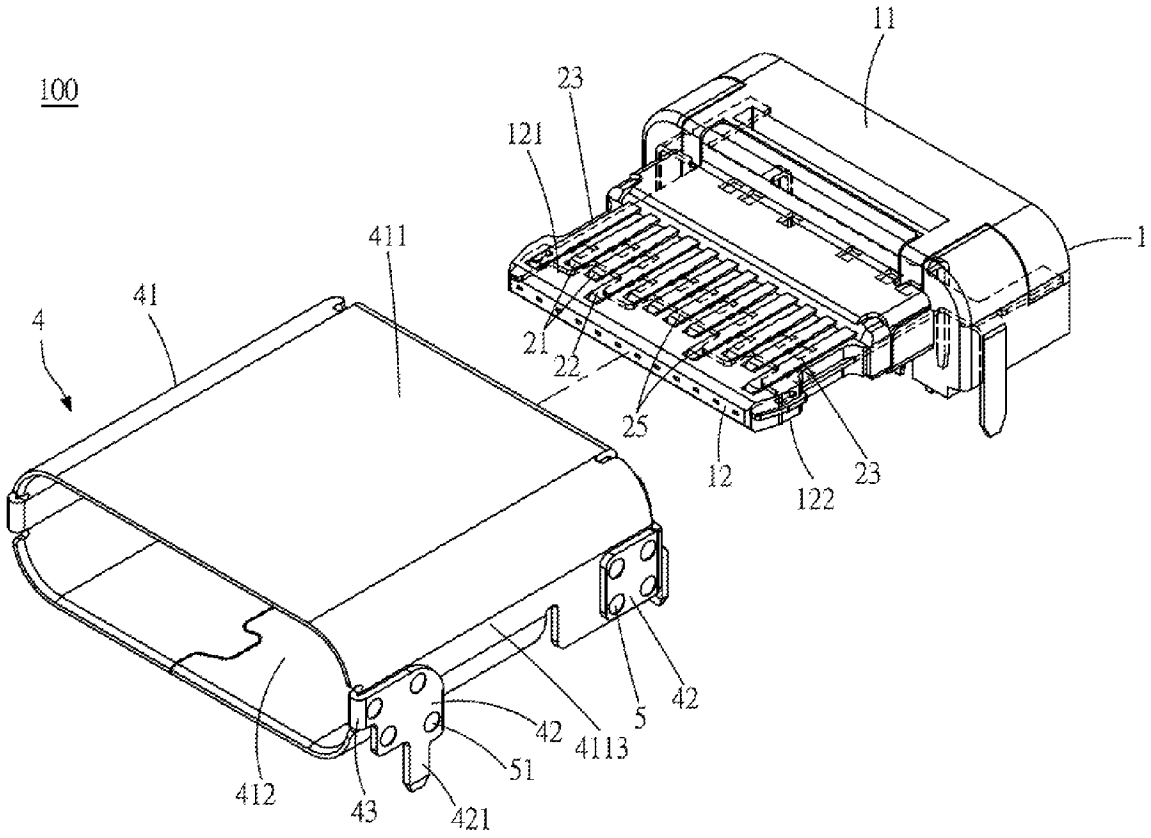
FIG. 3 is an exploded view (1) showing an insulated housing and receptacle terminals received in the metallic shell of the electrical receptacle connector according to the first embodiment.
Figure 4:
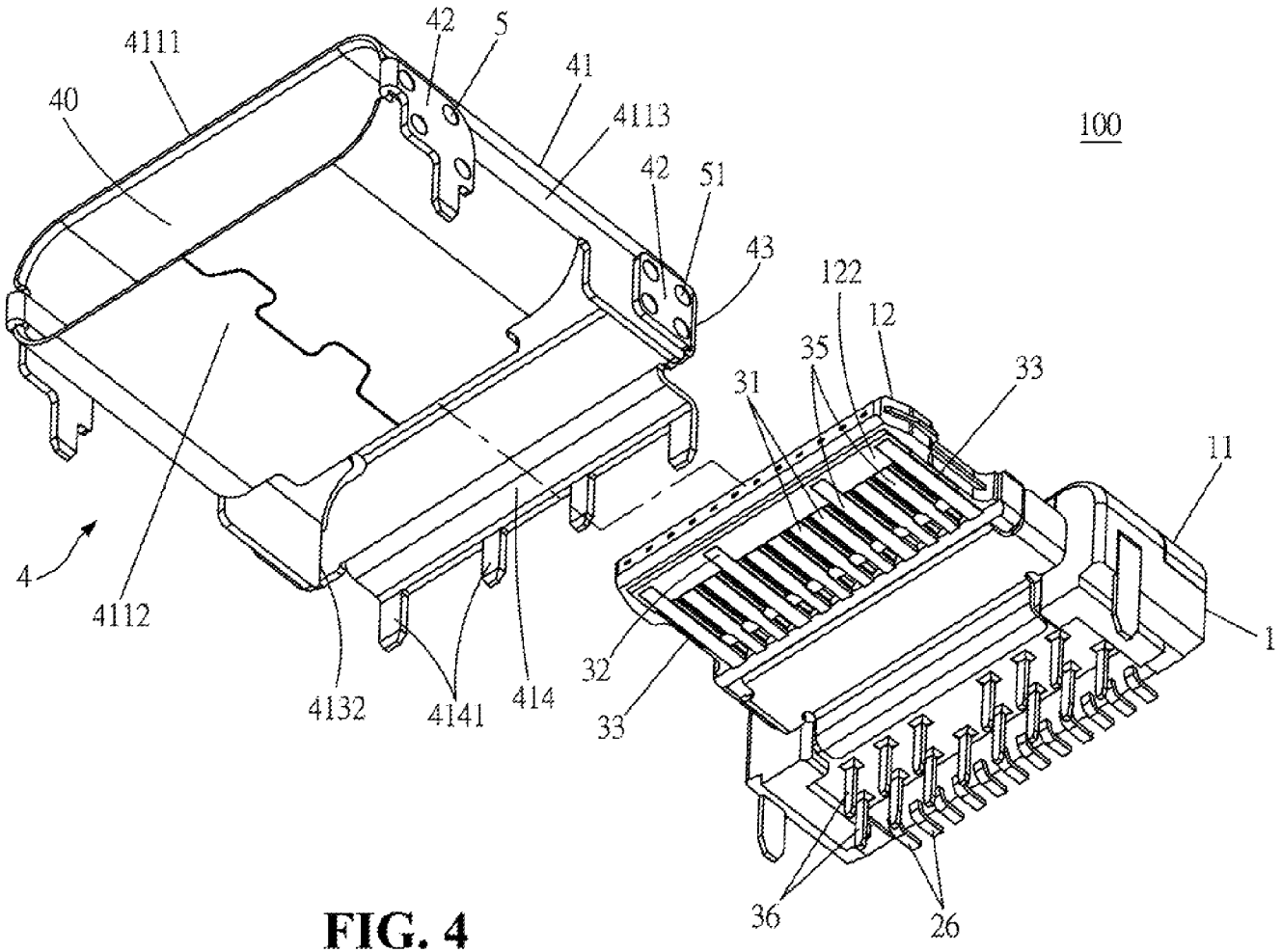
FIG. 4 is an exploded view (2) showing the insulated housing and the receptacle terminals received in the metallic shell of the electrical receptacle connector according to the first embodiment.

Please refer to FIG. 1 to FIG. 4, which illustrate an electrical receptacle connector 100 according to a first embodiment of the instant disclosure. FIG. 1 is a perspective view of an electrical receptacle connector 100 according to a first embodiment of the instant disclosure. FIG. 2 is an exploded perspective view of the electrical receptacle connector 100 of the first embodiment. FIG. 3 is an exploded view (1) showing an insulated housing 1 and receptacle terminals 2, 3 are to be received in a metallic shell 4 of the electrical receptacle connector 100, according to first embodiment. FIG. 4 is an exploded view (2) showing the insulated housing 1 and the receptacle terminals 2, 3 are to be received in the metallic shell 4 of the electrical receptacle connector 100, according to the first embodiment. The electrical receptacle connector 100 described herein provides a USB Type-C connection interface. The electrical receptacle connector 100 comprises an insulated housing 1, a plurality of upper-row receptacle terminals 2, a plurality of lower-row receptacle terminals 3, and a metallic shell 4.

Please refer to FIG. 2, FIG. 3 and FIG. 4, in which the insulated housing 1 comprises a base portion 11 and a tongue portion 12. Here, injection molding techniques are applied to form the base portion 11 and the tongue portion 12. Furthermore, the insulated housing 1 can be formed by a unitary member or a multi-piece member. Additionally, the tongue portion 12 is extended from one side of the base portion 11 in the front-to-rear direction, and the tongue portion 12 has an upper surface 121 and a lower surface 122 in which the upper surface 121 is opposite to the lower surface 122.

Please refer to FIG. 2, in which embodiment the electrical receptacle connector 100 further comprises a grounding sheet 6 disposed inside the insulation housing 1. The grounding sheet 6 comprises a main body 60 and a plurality of contacts 62. The main body 60 is disposed between the upper-row terminals 2 and the lower-row terminals 3. That is, the main body 60 is formed between the base portion 11 and the tongue portion 12 to be between the upper-row terminals 2 and the lower-row terminals 3. Furthermore, the contacts 62 that can be mounted or soldered on the surface of a printed circuit board (PCB) by using through-hole technology are protruded out from the lateral sides of the base portion 21. The structural strength of the tongue portion 12 can be improved by the grounding sheet 6 disposed inside the tongue portion 12. Here, when the upper-row terminals 2 and the lower-row terminals 3 are transmitting USB 3.0 signals, effective noise grounding and conduction can be accomplished by connecting the contacts 62 of the grounding sheet 6 to the printed circuit board (PCB). Additionally, the grounding sheet 6 further comprises two lateral sides 600 which are protruded out the lateral sides of the tongue portion 12.

Figure 6:
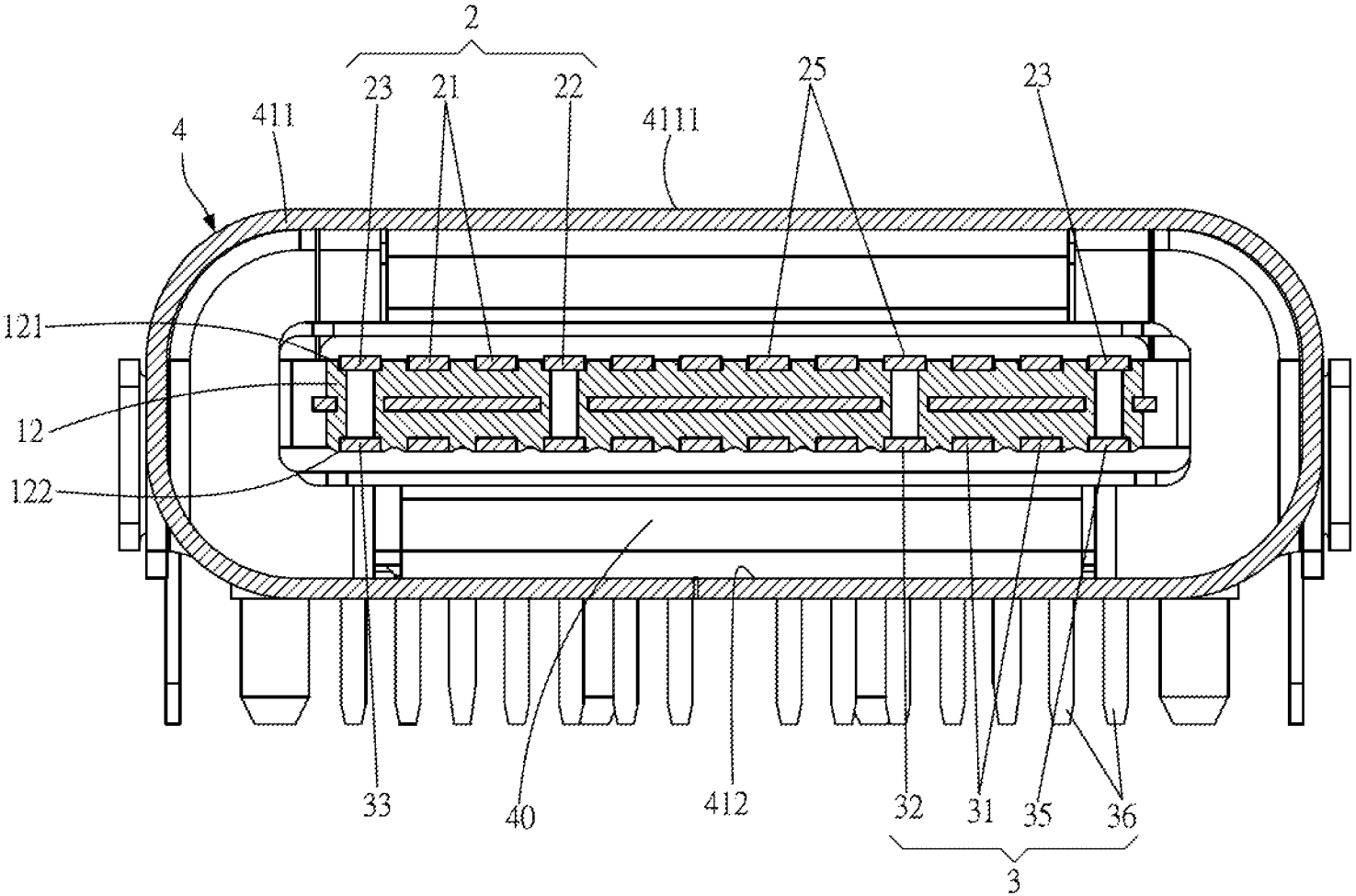
FIG. 6 is a front sectional view of the electrical receptacle connector of the first embodiment.
Figure 7:
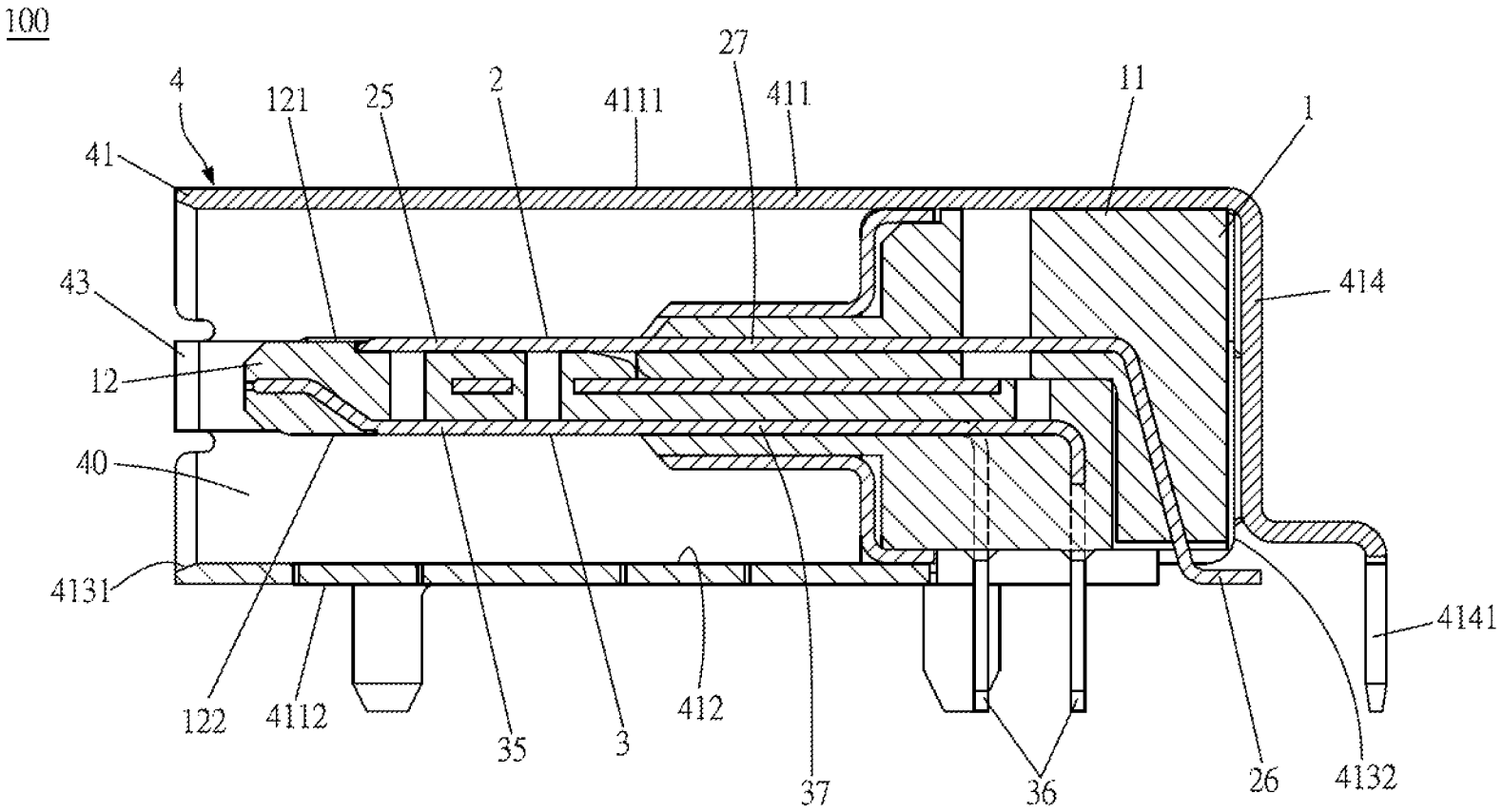
FIG. 7 is a lateral sectional view of the electrical receptacle connector of the first embodiment.

FIG. 6 is a front sectional view of the electrical receptacle connector 100 of the first embodiment. FIG. 7 is a lateral sectional view of the electrical receptacle connector 100 of the first embodiment. Please refer to FIG. 3, FIG. 6 and FIG. 7, in which the upper-row receptacle terminals 2 are held in the base portion 11 and disposed at the upper surface 121 of the tongue portion 12. Each of the upper-row receptacle terminals 2 which are elongated and flat shapes comprises a flat contact portion 25, a body portion 27, and a tail portion 26. The body portions 27 are held in the base portion 11 and disposed at the upper surface 121 of the tongue portion 12. For each of the upper-row receptacle terminals 2, the flat contact portion 25 is extended from one of two ends of the body portion 27 and disposed at the upper surface 121 of the tongue portion 12, and the tail portion 26 is extended from the other end of the body portion 27 and exposed out of the base portion 11. Furthermore, the tail portions 26 are extended out of a bottom of the base portion 11. Furthermore, the tail portions 26 are bent horizontally to form flat legs, named SMT legs, which can be mounted or soldered on the surface of a printed circuit board (PCB) by using surface mount technology, as shown in FIG. 4.

Please refer to FIG. 4, FIG. 6 and FIG. 7, in which the lower-row receptacle terminals 3 are held in the base portion 11 and disposed at the lower surface 122 of the tongue portion 12. The lower-row receptacle terminals 3 are configured below the upper-row receptacle terminals 2 with interval. Each of the lower-row receptacle terminals 3 which are elongated and flat shapes comprises a flat contact portion 35, a body portion 37, and a tail portion 36. The body portions 37 are held in the base portion 11 and disposed at the lower surface 122 of the tongue portion 12. For each of the lower-row receptacle terminals 3, the flat contact portion 35 is extended from one of two ends of the body portion 37 and disposed at the lower surface 122 of the tongue portion 12, and the tail portion 36 is extended from the other end of the body portion 37 and exposed out of the base portion 11. Furthermore, the tail portions 36 are extended out of the bottom of the base portion 11. Furthermore, the tail portions 36 are extended downward to form vertical legs, named through-hole legs, which can be mounted or soldered on the surface of a printed circuit board (PCB) by using through-hole technology, as shown in FIG. 4. In this embodiment, the tail portions 26, 36 are protruded out of the base portion 11 and arranged separately. For example, the tail portions 26, 36 form three rows.

Figure 5:
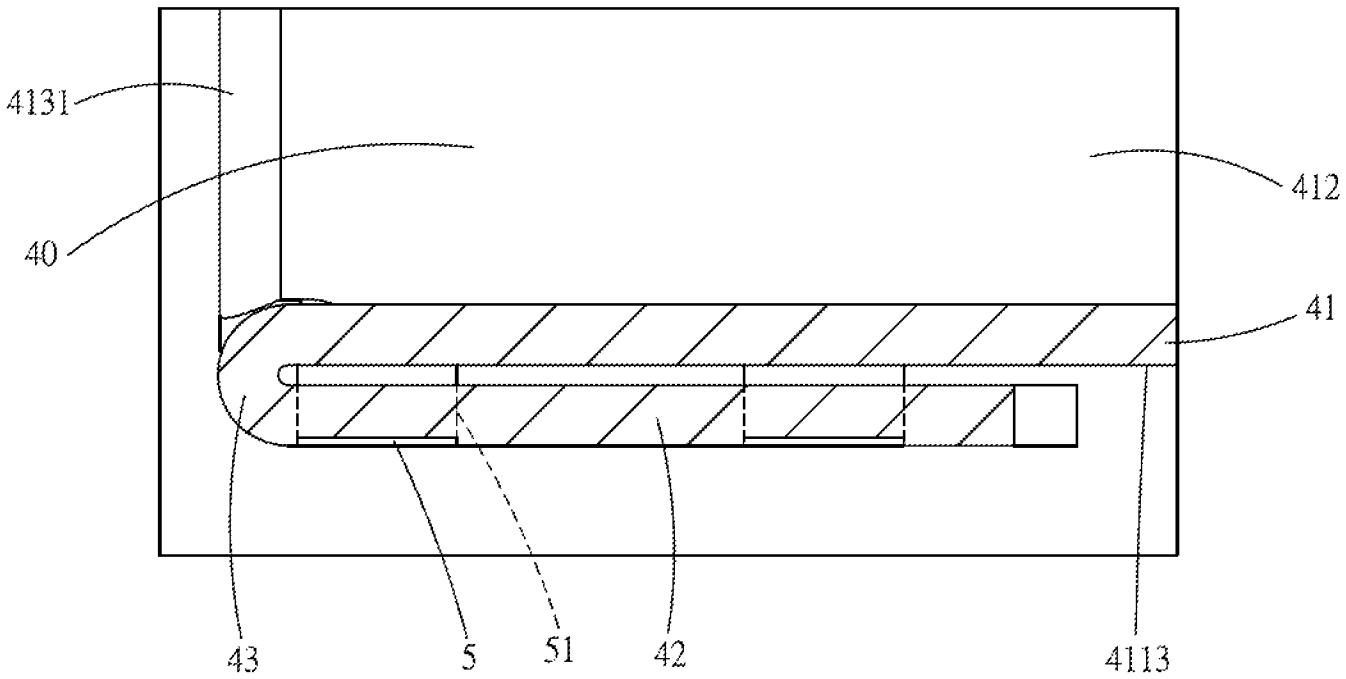
FIG. 5 is a sectional view showing a tubular body which includes a connecting plate and a folded portion according to the first embodiment.

FIG. 5 is a sectional view showing a tubular body 41 of the electrical receptacle connector 100 which further includes a connecting plate 42 and a folded portion 43 according to the first embodiment. Please refer to FIG. 2, FIG. 5 and FIG. 7, in which the metallic shell 4 defines a receiving cavity 40 therein to receive the insulated housing 1. In this embodiment, the metallic shell 4 comprises a tubular body 41, a plurality of connecting plates 42, and a plurality of folded portions 43. Additionally, the metallic shell 4 is a hollowed shell, and the tubular body 41, the connecting plates 42, and the folded portions 43 are formed by bending and machining a one-piece plate. That is, the tubular body 41, the connecting plates 42, and the folded portions 43 are formed integrally as a whole, and the connecting plates 42 and the folded portions 43 are formed on the tubular body 41 by bending processes. In this embodiment, the tubular body 41 has an outer wall 411 and an inner wall 412. The outer wall 411 is formed at the exterior of the tubular body 41, and the inner wall 412 is formed at the interior of the tubular body 41. Here, the outer wall 411 is defined by a top plane 4111, a bottom plane 4112, and a plurality of lateral planes 4113, and the lateral planes 4113 are extended from two sides of the top plane 4111 toward two sides of the bottom plane 4112 respectively. That is, the top plane 4111, the bottom plane 4112 and the lateral planes 4113 define the hollow shell. Additionally, each of the connecting plates 42 is a thin plate. The connecting plates 42 are at the outer wall 4111, so that the connecting plates 42 are stacked on the tubular body 41. That is, the connecting plates 42 are disposed on the lateral planes 4113 respectively. Some of the connecting plates 42 further comprise at least one through-hole leg 421, which is adapted for being mounted on a printed circuit board (PCB) by through-hole technology. The through-hole leg 421 is extended from the connecting plate 42 downward and vertically. The connecting plates 42 are disposed at the outer wall 411, and the through-hole leg 42 is extended under a bottom of the insulated housing 1. The folded portions 43 are respectively extended from two sides of the tubular body 41 toward the connecting plates 42. Furthermore, one of two ends of the folded portion 43 is extended from the periphery of the tubular body 41, and the other end of the folded portion 43 is extended toward the corresponding connecting plate 42. Additionally, a front window 4131, rectangular-shaped or oblong-shaped, is formed at one side of the metallic shell 4. The front window 4131 communicates with the receiving cavity 40. Furthermore, the folded portions 43 are respectively extended from two sides of the periphery of the front window 4131 toward the connecting plates 42. Accordingly, some of the folded portions 43 and the connecting plates 42 are formed on the front part of the tubular body 41 with the folded portions 43 being folded backward with respect to the connecting plates 42 and some of the folded portions 43 and the connecting plates 42 are formed on the rear part of the tubular body 41 with the folded portions 43 being folded forwardly with respect to the connecting plates 42, but embodiments are not limited thereto.

Please refer to FIG. 2 and FIG. 5, in which a plurality of connecting portions 5 is configured to fix the connecting plates 42 to the tubular body 41. The connecting portions 5 are respectively provided to fix the tubular body 41 with the connecting plates 42. The methods for fixing the tubular body 41 with the connecting plates 42 are described as following. In one implementation aspect, each of the connecting portions 5 comprises a connecting point 51 configured to the connecting plate 42, such that the connecting plates 42 and the tubular body 41 are fixed with each other. That is, proper laser beam welding techniques may be applied on the surface of each of the connecting plates 42, so that the connecting points 51 are formed on the connecting plates 42 and then connecting points 51 are configured on the outer wall 411 of the tubular body 41. Therefore, the connecting plates 42 and the tubular body 41 are securely fixed with each other and formed as a unitary member.

Figure 8:
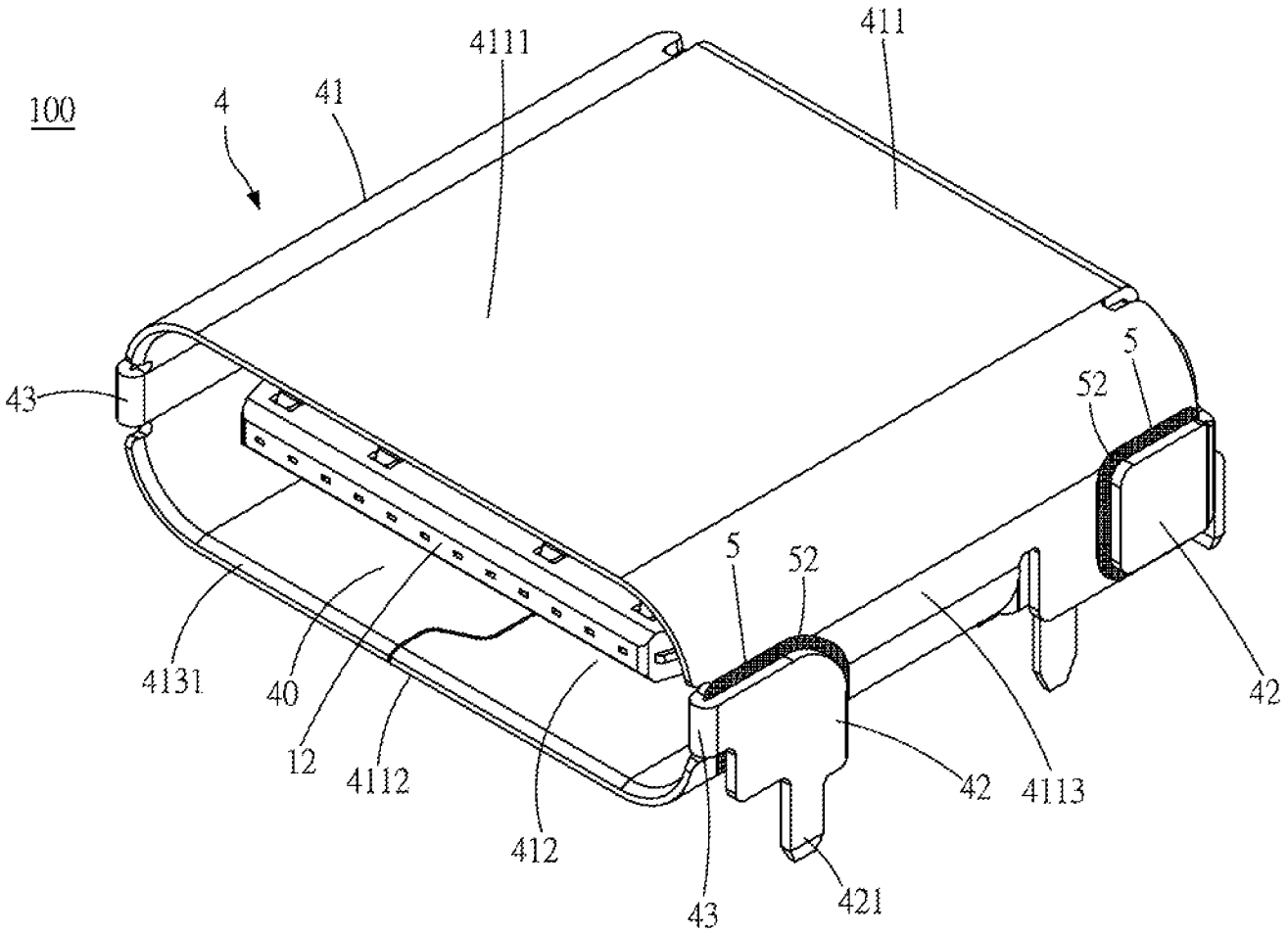
FIG. 8 is a perspective schematic view showing the connecting segments are configured to the connecting plates of the electrical receptacle connector of the first embodiment.
Figure 9:
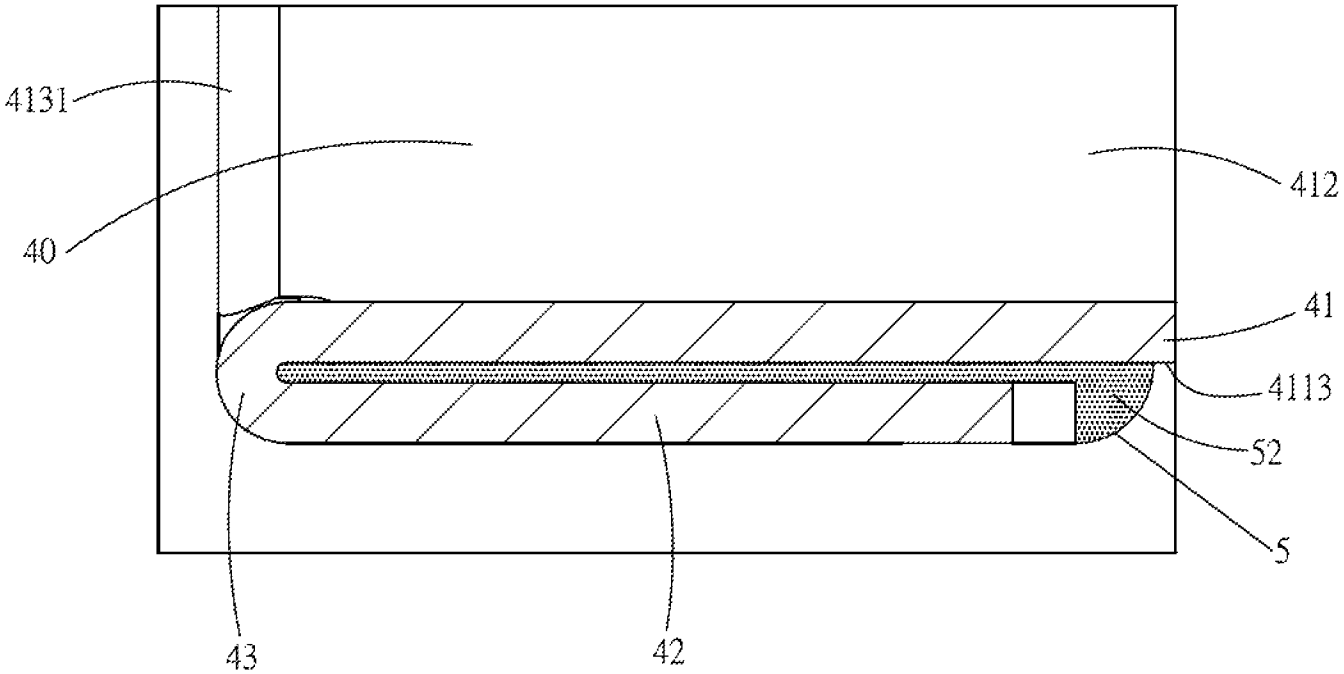
FIG. 9 is a sectional schematic view showing the connecting segments are configured to the connecting plates of the electrical receptacle connector of the first embodiment.

FIG. 8 is a perspective schematic view showing the connecting segments 52 are configured to the connecting plates 42 of the electrical receptacle connector 100 of the first embodiment. FIG. 9 is a sectional schematic view showing the connecting segments 52 are configured to the connecting plates 42 of the electrical receptacle connector 100 of the first embodiment. Please refer to FIG. 8 and FIG. 9. In another implementation aspect, each of the connecting portions 5 comprises a connecting segment 52 configured to lateral peripheries of the connecting plate 42 and the tubular body 41. That is, proper tin-soldering techniques may be applied to connect the lateral peripheries of the connecting plates 42 with the outer wall 411 of the tubular body 41, so that the connecting plates 42 and the tubular body 41 are securely fixed with each other. During the soldering process, soldering materials (for example, tin) are applied to the lateral peripheries of the connecting plates 42, so that the lateral peripheries of the connecting plates 42 form a soldered segment to combine with the outer wall 411 of the tubular body 41. Therefore, the connecting plates 42 and the tubular body 41 are securely fixed with each other and formed as a unitary member.

In some implementation aspects, each of the connecting plates 42 may comprise an abutting plate engaged with the tubular body 41, so that the connecting plates 42 are connected securely with the tubular body 41. Alternatively, the tubular body 41 may comprise a plurality of abutting plates respectively engaged with the connecting plates 42, so that the tubular body 41 and the connecting plates 42 are connected securely with each other by the abutting plates.

To assemble the electrical receptacle connector 100 on a circuit board, the through-hole legs 421 of each of the connecting plates 42 are aligned to be inserted into the through holes of the circuit board, respectively. Hence, the connecting plates 42 are securely fixed to the two sides of the tubular body 41 by the connecting portions 5, respectively. Therefore, the distance between the connecting plates 42 can be maintained from being too long or too short. Additionally, the metallic shell 4 is machined and bent by a unitary plate to form the tubular body 41, the connecting plates 42, and the folded portions 43. Thus, two sides of the tubular body 41 are grounded by the through-hole legs 421 of the connecting plates 42, so that the poor-shielding problems caused by the breaches of the existing connector can be improved. Conversely, based on embodiments of the instant disclosure, the tubular body 41 having the through-hole legs 421 can also prevent the EMI and RFI problems raised by the breaches of the existing connector.

Please refer to FIG. 6, FIG. 6A and FIG. 7, in which the upper-row receptacle terminals 2 comprise a plurality of signal terminals 21, a plurality of power terminals 22, and a plurality of ground terminals 23. The upper-row receptacle terminals 2 comprise, from left to right, a ground terminal 23 (Gnd), a first pair of differential signal terminals (TX1+−), a second pair of differential signal terminals (D+−), and a third pair of differential signal terminals (RX2+−) of the signal terminals 21, power terminals 22 (Power/VBUS) between the three pairs of differential signal terminals, a retain terminal (RFU) and another ground terminal 23 (Gnd). However, the pin assignments are not thus limited, and the example described here is only for illustrative purposes. In this embodiment, twelve upper-row receptacle terminals 2 are provided for transmitting USB 3.0 signals, but embodiments are not limited thereto. In some implementation aspects, the far right ground terminal 23 (or the far left ground terminal 23) and the retain terminal are omitted. Furthermore, the far right ground terminal 23 may be replaced by a power terminal 22 and provided for power transmission. That is, the upper-row receptacle terminals 2 may comprise plural signal terminals 21, at least one power terminal 22, and at least one ground terminal 23.

Please refer to FIG. 6 and FIG. 7, in which the lower-row receptacle terminals 3 comprise a plurality of signal terminals 31, a plurality of power terminals 32, and a plurality of ground terminals 33. The lower-row receptacle terminals 3 comprise, from right to left, a ground terminal 33 (Gnd), a first pair of differential signal terminals (TX2+−), a second pair of differential signal terminals (D+−), and a third pair of differential signal terminals (RX1+−) of the signal terminals 31, power terminals 32 (Power/VBUS), between the three pairs of differential signal terminals, a retain terminal (RFU) and another ground terminal 33. However, the pin assignments are not thus limited, and the example described above is only for illustrative purposes. In this embodiment, twelve lower-row receptacle terminals 3 are provided for transmitting USB 3.0 signals, but embodiments are not limited thereto. In some implementation aspects, the far right ground terminal 33 (or the far left ground terminal 33) and the retain terminal are omitted. Additionally, the far right ground terminal 33 may be replaced by a power terminal 32 and provided for power transmission. That is, the lower-row receptacle terminals 3 may comprise plural signal terminals 31, at least one power terminal 32, and at least one ground terminal 33.

In the previous embodiments, the upper-row receptacle terminals 2 and the lower-row receptacle terminals 3 meet the transmission of USB 3.0 signals, but embodiments are not limited thereto. In some implementation aspects, for the upper-row receptacle terminals 2 in accordance with transmission of USB 2.0 signals, the first and third pairs of differential signal terminals are omitted, and the second pair of differential signal terminals and the power terminals 22 are retained for transmitting USB 2.0 signals. For the lower-row receptacle terminals 3 in accordance with transmission of USB 2.0 signals, the first and third pairs of differential signal terminals are omitted, and the second pair of differential signal terminals and the power terminals 32 are retained for transmitting USB 2.0 signals.

Please refer to FIG. 2, FIG. 6, FIG. 6A and FIG. 7, in which embodiment the upper-row receptacle terminals 2 and the lower-row receptacle terminals 3 are respectively disposed at the upper surface 121 and the lower surface 122 of the tongue portion 12. Furthermore, the upper-row receptacle terminals 2 and the lower-row receptacle terminals 4 are point-symmetrical with a central point of the receptacle cavity 40 as the symmetrical center. In other words, pin-assignments of the upper-row receptacle terminals 2 and the lower-row receptacle terminals 3 have 180 degree symmetrical design with respect to the central point of the receptacle cavity 10 as the symmetrical center. The dual or double orientation design enables an electrical plug connector to be inserted into the electrical receptacle connector 100 in either of two intuitive orientations, i.e., in either upside-up or upside-down directions. Here, point-symmetry means, after the upper-row receptacle terminals 2 (or the lower-row receptacle terminals 3) are rotated by 180 degrees with the symmetrical center as the rotating center, the upper-row receptacle terminals 2 and the lower-row receptacle terminals 3 are overlapped. That is, the rotated upper-row receptacle terminals 2 are arranged at the position of the original lower-row receptacle terminals 3, and the rotated lower-row receptacle terminals 3 are arranged at the position of the original upper-row receptacle terminals 2. In other words, the upper-row receptacle terminals 2 and the lower-row receptacle terminals 3 are arranged upside down, and the pin assignments of the upper-row receptacle terminals 2 are left-right reversal with respect to the pin assignments of the lower-row receptacle terminals 3. Accordingly, an electrical plug connector is inserted into the electrical receptacle connector 100 with a first orientation where the upper surface 121 of the tongue portion 12 of the electrical receptacle connector 100 is facing upward, for transmitting first signals. Conversely, the electrical plug connector is inserted into the electrical receptacle connector 100 with a second orientation where the upper surface 121 of the tongue portion 12 of the electrical receptacle connector 100 is facing downward, for transmitting second signals. The specification for transmitting the first signals conforms to that for transmitting the second signals. Based on this, the inserting orientation of the electrical plug connector is not limited by the electrical receptacle connector 100.

Please refer to FIG. 2, FIG. 6, FIG. 6A, and FIG. 7, in which embodiment positions of the upper-row receptacle terminals 2 correspond to positions of the lower-row receptacle terminals 3.

Please refer to FIG. 4 and FIG. 7, in which embodiment, the tubular body 41 further comprises a rear cover plate 414. The rear cover plate 414 covers the back side of the receptacle cavity 40, so that the exposed area of the metallic shell 4 can be reduced. The folded portions 43 are respectively extended from two sides of the rear cover plate 414 toward the connecting plates 42. That is, each of the folded portions 43 is at the corresponding side of the rear cover plate 414 and extended toward the corresponding connecting plate 42. Furthermore, the connecting plates 42 are at the outer wall 411. That is, the connecting plates 42 are respectively at the lateral planes 4113. The rear cover plate 414 comprises a plurality of through-hole legs 4141 extended from a bottom of the rear cover plate 414 toward the bottom of the insulated housing 1. The through-hole legs 4141 are extended downward and vertically, so that noise grounded can be accomplished by the through-hole legs 4141. Here, the folded portions 43 and the connecting plates 42 are formed on the rear part of the tubular body 41 with the folded portions 43 being folded forward with respect to the connecting plates 42, but embodiments are not limited thereto. In addition, the connecting portions 5 are provided to fix the tubular body 41 with the connecting plates 42 at the two sides of the rear cover plate 414. The methods for fixing the connecting plates 42 with the tubular body 41 are provided as above. Under such arrangement, the tubular body 41 and the connecting plates 42 are securely fixed with each other by the connecting portions 5, and the rear cover plate 414 is securely fixed with the rear part of the tubular body 41.

After the through-hole legs 4141 of the rear cover plate 414 are inserted into the through holes of the circuit board and applied with proper soldering techniques, the rear cover plate 414 is securely covered on the rear part of the tubular body 41. Therefore, the electrical receptacle connector 100 can be securely fixed with the circuit board. As a result, when the electrical receptacle connector 100 is connected to an electrical plug connector with the electrical receptacle connector 100 being pulled unintentionally, gaps are not formed between the rear cover plate 414 and the metallic shell 4, and the shielding function of the metallic shell 4 can be provided efficiently for the components inside the metallic shell 4. That is, the through-hole legs 4141 of the rear cover plate 414 strengthen the positioning force for the electrical receptacle connector 100 to secure with the circuit board. Therefore, the electrical receptacle connector 100 provides better results in bending tests and wrenching strength. Additionally, the through-hole legs 4141 of the rear cover plate 414 are soldered on the circuit board to reduce the grounding resistance and the electromagnetic interference (EMI).

Figure 10:
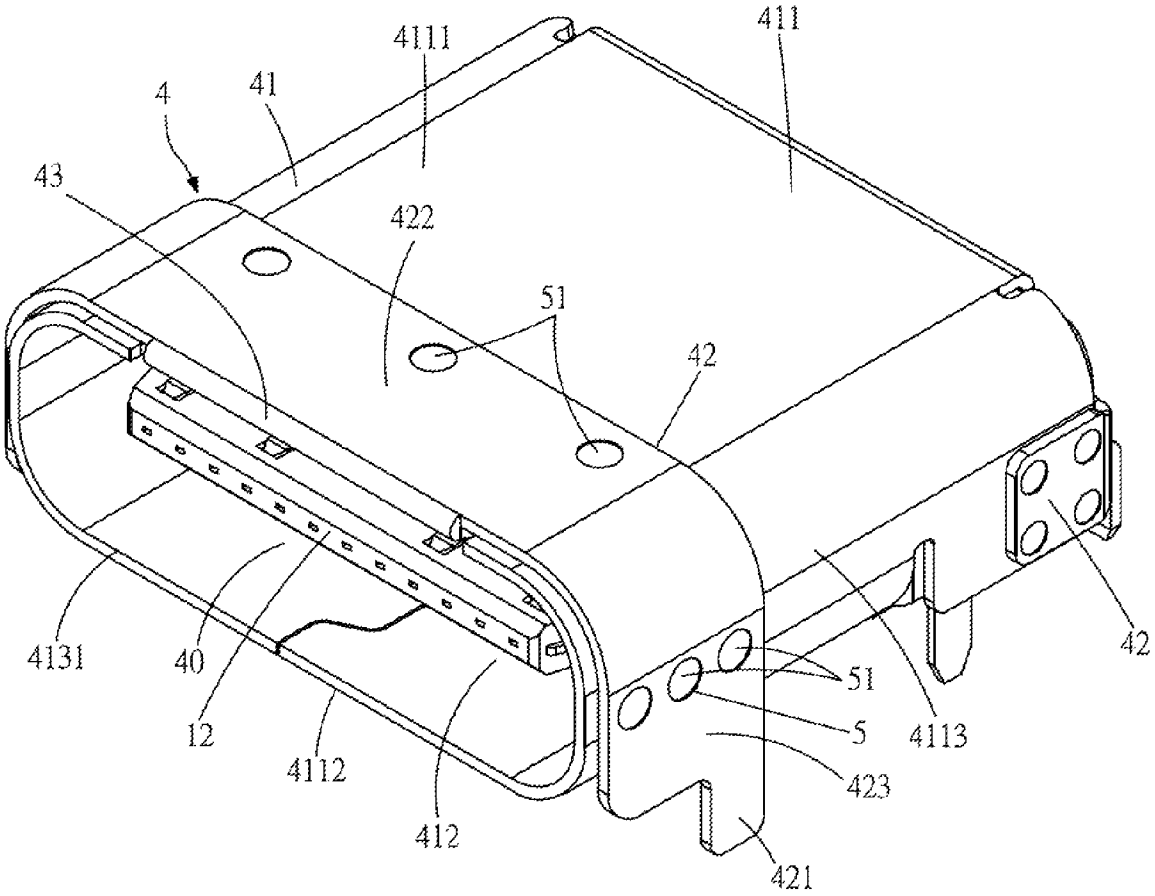
FIG. 10 is a perspective view of an electrical receptacle connector according to a second embodiment of the instant disclosure.

FIG. 10 is a perspective view of an electrical receptacle connector 100 according to a second embodiment of the instant disclosure. The structure of the second embodiment is approximately the same as that of the first embodiment, except that in the second embodiment, one folded portion 43 is provided and extended from the periphery of a top portion of the front window 4131 toward the connecting plate 42. Here, the electrical receptacle connector 100 comprises one connecting plate 42, and the connecting plate 42 is a unitary plate. The connecting plate 42 comprises a top plate 422 and a plurality of lateral plates 423. The top plate 422 is at the top plane 4111, and the lateral plates 423 are at the lateral planes 4113, respectively. The through-hole legs 421 are respectively at the lateral plates 423 and extended downward and vertically. The through-hole legs 421 are extended toward the bottom of the insulated housing 1. The folded portion 43 is extended from the periphery of the top portion of the front window 4131 and bent toward the top plate 422. Under this arrangement, the folded portion 43 and the connecting plate 42 are formed on the front part of the tubular body 41 with the folded portion 43 being folded upward with respect to the connecting plate 42. Additionally, the connecting portions 5 are provided to fix the tubular body 41 with the connecting plate 42. That is, the connecting portions 5 can be configured on the top plate 422, on the lateral plates 423 of the connecting plate 42, or on both the top plate 422 and the lateral plates 423 of the connecting plate 42, so that the tubular body 41 and the connecting plate 42 are fixed with each other by the connecting portions 5. The methods for fixing the connecting plate 42 with the tubular body 41 are provided as above. Here, the connecting plate 42 is provided to cover the tubular body 41 so as to strengthen the architecture of the tubular body 41. Further, the area for machining and configuring the connecting portions 5 is increased so as to simplify the machining process, improve the fixing function, and to stably confine the distance between the through-hole legs 421.

Figure 11:
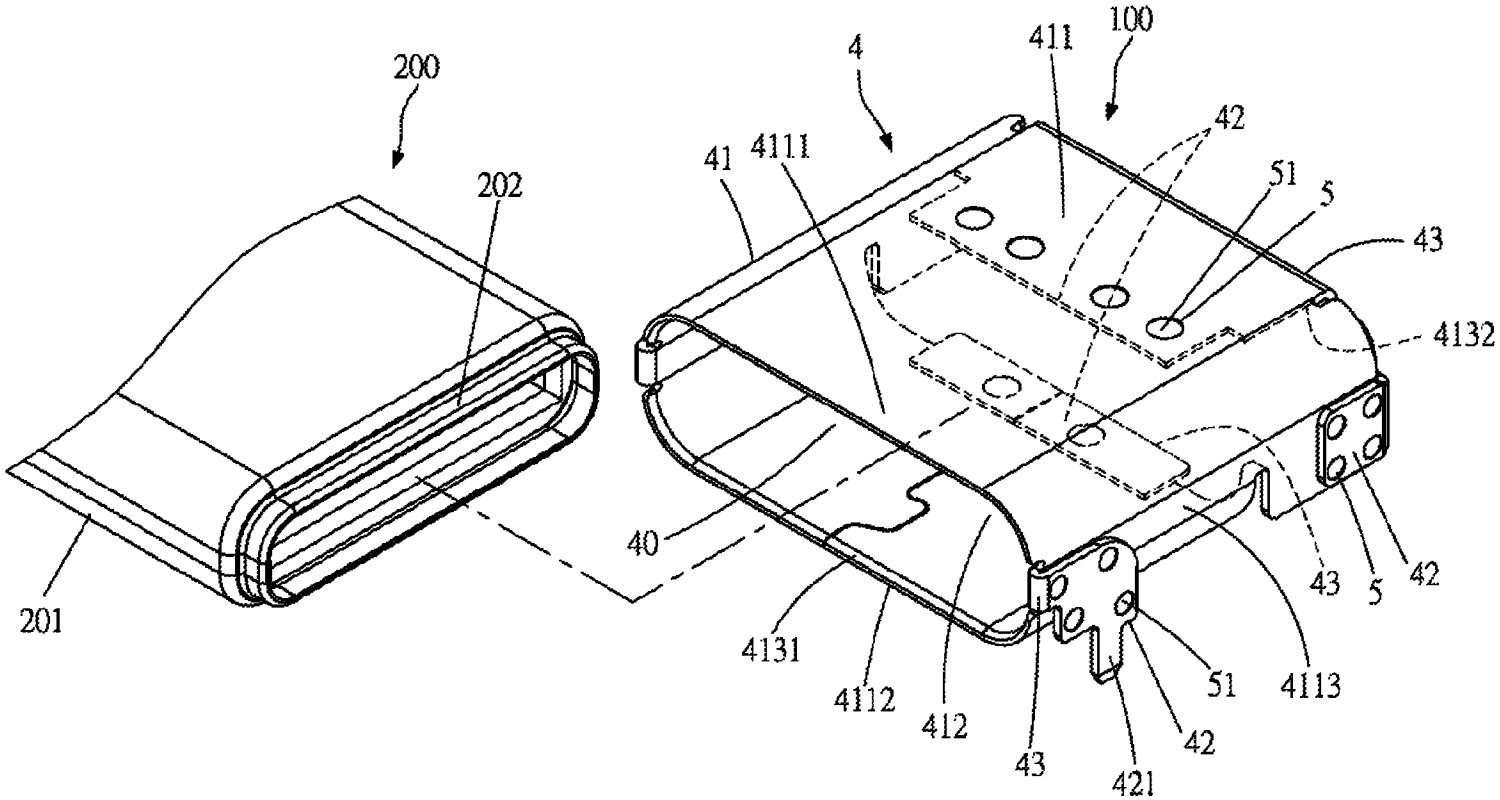
FIG. 11 is a perspective view of an electrical receptacle connector according to a third embodiment of the instant disclosure.

FIG. 11 is a perspective view of an electrical receptacle connector 100 according to a third embodiment of the instant disclosure. The structure of the third embodiment is approximately the same as that of the first embodiment, except that in the third embodiment, the tubular body 41 further comprises a rear window 4132. At least two folded portions 43 are extended from two sides of the rear window 4132. That is, the folded portions 43 are respectively extended from upper and lower sides of the rear window 4132 toward at least two connecting plates 42, and the connecting plates 42 are respectively at an upper inner wall and a lower inner wall of the tubular body 41, as shown in FIG. 11. Additionally, the connecting portions 5 are configured to fix the connecting plates 42 to the tubular body 41. That is, the connecting portions 5 can be formed by applying proper machining techniques to the exterior of the tubular body 41. Taking laser beam welding technique as an example, laser beams are applied to the top and the bottom of the tubular body 41, so that the connecting portions 5 are provided to fix the tubular body 41 with the connecting plates 42. The methods for fixing the tubular body 41 with the connecting plates 42 by the connecting portions 5 are provided as above, and accordingly the connecting plates 42 and the tubular body 41 are firmly fixed with each other. Here, an electrical plug connector 200 comprises a tubular portion 202 formed at a front portion of a metallic shell 201 thereof. When the electrical plug connector 200 is mated with the electrical receptacle connector 100, the tubular portion 202 of the electrical plug connector 200 is in contact with the connecting plates 42 in the tubular body 41, so that the metallic shell 201 of the electrical plug connector 200 is in contact with the metallic shell 4 of the electrical receptacle connector 100 for effective noise conduction, thereby improving the existing EMI problem.

In conclusion, the connecting plates are configured to two sides of the tubular body by the connecting portions, so that the connecting plates are fixed with the tubular body, and the distance between the connecting plates are fixed, allowing the through-hole legs of the connecting plates to be inserted into the through holes of the circuit board. Furthermore, since the folded portions and the connecting plates are configured to the two sides of the tubular body, the existing insufficient shielding issue caused by the breaches of the existing connector can be improved. Additionally, improved noise grounding and conduction can be accomplished, thereby performing a better EMI shielding so as to reduce the EMI and RFI problems. Furthermore, pin-assignments of the upper-row receptacle terminals and the lower-row receptacle terminals are 180 degree symmetrical, dual or double orientation design which enable an electrical plug connector to be inserted into the electrical receptacle connector in either of two intuitive orientations, i.e., in either upside-up or upside-down directions. In other words, the pin-assignments of the upper-row receptacle terminals and the lower-row receptacle terminals have 180 degree symmetrical, dual or double orientation design with respect to a central point of the receptacle cavity as the symmetrical center. Consequently, an electrical plug connector is inserted into the electrical receptacle connector with a first orientation where the upper surface of the tongue portion is facing up, for transmitting first signals. Conversely, the electrical plug connector is inserted into the electrical receptacle connector with a second orientation where the upper surface of the tongue portion is facing down, for transmitting second signals. Furthermore, the specification for transmitting the first signals is conformed to the specification for transmitting the second signals.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

an insulated housing comprising a base portion, and a tongue portion extended from one side of the base portion, wherein the tongue portion has an upper surface and a lower surface;

a plurality of upper-row receptacle terminals comprising a plurality of signal terminals, at least one power terminal, and at least one ground terminal, wherein each of the upper-row receptacle terminals is held in the base portion and disposed at the upper surface of the tongue portion;

a plurality of lower-row receptacle terminals comprising a plurality of signal terminals, at least one power terminal, and at least one ground terminal, each of the lower-row receptacle terminals is held in the base portion and disposed at the lower surface of the tongue portion;

a metallic shell defining a receiving cavity therein to receive the insulated housing, wherein the metallic shell comprises:

a tubular body having an outer wall and an inner wall;

at least one connecting plate disposed at the outer wall or the inner wall; and at least one folded portion extended from the tubular body toward the connecting plate; and a plurality of connecting portions configured to fix the connecting plate to the tubular body so that the connecting plate is fixed on the tubular body.

2. The electrical receptacle connector according to claim 1, wherein the outer wall is defined by a top plane, a bottom plane, and a plurality of lateral planes, the lateral planes are extended from two sides of the top plane toward two sides of the bottom plane, respectively.

3. The electrical receptacle connector according to claim 2, wherein the tubular body comprises a front window, wherein the folded portion is extended from the periphery of the front window toward the connecting plate.

4. The electrical receptacle connector according to claim 3, wherein the folded portion is extended from the periphery of a top portion of the front window toward the connecting plate, the connecting plate comprises a top plate and a plurality of lateral plates, the top plate is at the top plane, and the lateral plates are respectively at the lateral planes.

5. The electrical receptacle connector according to claim 3, wherein at least two folded portions are respectively extended from two sides of the periphery of the front window toward at least two connecting plates, wherein the connecting plates are respectively at the lateral planes.

6. The electrical receptacle connector according to claim 1, wherein the connecting plate comprises a plurality of through-hole legs, wherein the connecting plate is at the outer wall and the through-hole leg is extended under a bottom of the insulated housing.

7. The electrical receptacle connector according to claim 1, wherein the tubular body comprises a rear cover plate, wherein at least two folded portions are respectively extended from two sides of the rear cover plate toward at least two connecting plates, wherein the connecting plates are at the outer wall, the rear cover plate further comprises a plurality of through-hole legs, the through-hole legs are extended under a bottom of the rear cover plate toward a bottom of the insulated housing.

8. The electrical receptacle connector according to claim 1, wherein the tubular body comprises a rear window, wherein at least two folded portions are respectively extended from two sides of the rear window toward at least two connecting plates, wherein the connecting plates are at the inner wall.

9. The electrical receptacle connector according to claim 1, wherein each of the connecting portions comprises a connecting point soldered on the connecting plate, so that the connecting plate is fixed with the tubular body.

10. The electrical receptacle connector according to claim 1, wherein each of the connecting portions comprises a connecting segment tin-soldered on the connecting plate, so that the connecting plate is fixed with the tubular body.

11. The electrical receptacle connector according to claim 1, wherein each of the upper-row receptacle terminals comprises:

a body portion held in the insulated housing;

a flat contact portion extended from one of two ends of the body portion and disposed at the upper surface; and a tail portion extended from the other end of the body portion and exposed out of the insulated housing.

12. The electrical receptacle connector according to claim 1, wherein each of the lower-row receptacle terminals comprises:

a body portion held in the insulated housing;

a flat contact portion extended from one of two ends of the body portion and disposed at the upper surface; and a tail portion extended from the other end of the body portion and exposed out of the insulated housing.

13. The electrical receptacle connector according to claim 1, wherein the upper-row receptacle terminals and the lower-row receptacle terminals have 180 degree symmetrical design with respect to a central point of the receptacle cavity as the symmetrical center.

14. An electrical receptacle connector, comprising:

an insulated housing comprising a base portion, and a tongue portion extended from one side of the base portion, wherein the tongue portion has an upper surface and a lower surface;

a plurality of upper-row receptacle terminals comprising a plurality of signal terminals, at least one power terminal, and at least one ground terminal, wherein each of the upper-row receptacle terminals is held in the base portion and disposed at the upper surface of the tongue portion;

a plurality of lower-row receptacle terminals comprising a plurality of signal terminals, at least one power terminal, and at least one ground terminal, each of the lower-row receptacle terminals is held in the base portion and disposed at the lower surface of the tongue portion; and a grounding sheet disposed inside the insulation housing 1, wherein the grounding sheet comprises two lateral sides which are protruded out of the lateral sides of the a1tongue portion, wherein the electrical receptacle connector further comprises a metallic shell defining a receiving cavity therein to receive the insulated housing, wherein the metallic shell comprises: a tubular body having an outer wall and an inner wall; at least one connecting plate disposed at the outer wall or the inner wall; and at least one folded portion extended from the tubular body toward the connecting plate; and a plurality of connecting portions configured to fix the connecting plate to the tubular body so that the connecting plate is fixed on the tubular body.

15. The electrical receptacle connector according to claim 14, wherein the outer wall is defined by a top plane, a bottom plane, and a plurality of lateral planes, the lateral planes are extended from two sides of the top plane toward two sides of the bottom plane, respectively.

16. The electrical receptacle connector according to claim 15, wherein the tubular body comprises a front window, the folded portion is extended from the periphery of the front window toward the connecting plate.

17. The electrical receptacle connector according to claim 16, wherein the folded portion is extended from the periphery of a top portion of the front window toward the connecting plate, the connecting plate comprises a top plate and a plurality of lateral plates, the top plate is at the top plane, and the lateral plates are respectively at the lateral planes.

18. The electrical receptacle connector according to claim 16, wherein at least two folded portions are respectively extended from two sides of the periphery of the front window toward at least two connecting plates, wherein the connecting plates are respectively at the lateral planes.

19. The electrical receptacle connector according to claim 14, wherein the connecting plate comprises a plurality of through-hole legs, wherein the connecting plate is at the outer wall and the through-hole leg is extended under a bottom of the insulated housing.

* * * * *